US007575334B2

(12) United States Patent
Becnel

(10) Patent No.: US 7,575,334 B2
(45) Date of Patent: Aug. 18, 2009

(54) CHALK HOLDING DEVICE WITH LIGHT

(76) Inventor: Mark C. Becnel, 4364 Old Bayou Trail, Destin, FL (US) 32541

( * ) Notice: Subject to any disclaimer, the term of this patent is extended or adjusted under 35 U.S.C. 154(b) by 137 days.

(21) Appl. No.: 11/711,255

(22) Filed: Feb. 27, 2007

(65) Prior Publication Data

US 2008/0205038 A1 Aug. 28, 2008

(51) Int. Cl.
*B43K 29/10* (2006.01)

(52) U.S. Cl. ..... 362/118; 362/109; 362/249.06; 362/253; 362/579; 362/800; 434/417; 401/88

(58) Field of Classification Search ..... 362/109, 362/118–120, 191, 579, 252, 555; 434/417; 401/88; 473/36
See application file for complete search history.

(56) References Cited

U.S. PATENT DOCUMENTS

| | | | | |
|---|---|---|---|---|
| 1,222,948 | A | 4/1917 | Hawthorne | |
| 1,516,647 | A | 11/1924 | Saunders | |
| 1,538,055 | A | 5/1925 | Olsen | |
| D179,706 | S | 2/1957 | Schwartz | |
| 4,028,540 | A | 6/1977 | Key, Jr. et al. | |
| 4,518,274 | A | 5/1985 | Hanggi | |
| D300,087 | S | 3/1989 | Henderson | |
| D324,235 | S | 2/1992 | Moore | |
| D332,157 | S * | 12/1992 | Patterson | D30/155 |
| D345,991 | S | 4/1994 | Tzong-Taur | |
| 5,381,319 | A | 1/1995 | Shiao | |
| 5,430,952 | A | 7/1995 | Betts | |
| 5,544,967 | A | 8/1996 | Yao | |
| 5,815,939 | A | 10/1998 | Ruffer | |
| 6,793,429 | B2 * | 9/2004 | Arrison | 401/93 |
| 6,854,859 | B2 | 2/2005 | Cooper et al. | |
| 2005/0090851 | A1 * | 4/2005 | Devlin | 606/186 |
| 2005/0162846 | A1 | 7/2005 | Omowale | |
| 2007/0008715 | A1 * | 1/2007 | Chang et al. | 362/119 |
| 2008/0144309 | A1 * | 6/2008 | Nagata et al. | 362/120 |

FOREIGN PATENT DOCUMENTS

| | | | |
|---|---|---|---|
| WO | WO 02069247 | * | 9/2002 |

* cited by examiner

*Primary Examiner*—Anabel Ton
*Assistant Examiner*—Kevin Spinella
(74) *Attorney, Agent, or Firm*—Peter Loffler

(57) ABSTRACT

A chalk holding device for marking up dry walled walls of a building uses a pole that has a chalk holder at one end wherein chalk is received within the holder and locked in place via a compression ring. The pole may be threadably attached to an additional extension pole on the end opposite the chalk holding end. A light source is attached to the pole either by clamping the light source and attaching the clamp to the pole via another clamp, via adhesion or welding, or other appropriate attachment method, or the light source is an LED ring such that the pole passes through a central opening of the LED ring with the ring attached to the pole.

3 Claims, 5 Drawing Sheets

CHALK HOLDING DEVICE WITH LIGHT

BACKGROUND OF THE INVENTION

1. Field of the Invention

The present invention relates to a chalk holder having a light attached thereto such that the device is used for inspecting the interior drywall work within a building and has the ability to mark defects that require subsequent attention.

2. Background of the Prior Art

Hanging gypsum board and placing drywall board onto the interior walls of a building is a mundane process that is taken for granted by many building owners. However, as the dry walling process results in a viewable surface within the building, having only an additional layer or layers of paint thereon, it is critical that the process be performed correctly in order to have a satisfactorily finished interior. Defects within the drywall process, such as an elevated screw, an improperly taped joint, or an improper application of the finishing coat, will not be hidden by the paint coat and will be visible to the occupants of the building, an unsatisfactory result. For this reason, quality builders require that the drywall process be performed correctly and institute procedures to achieve a satisfactory result. After the board hangers and mudders perform their tasks, such builders require that every aspect of the work be inspected and any defects noted and corrected prior to the application of paint. As mistakes will happen even when the best crews are employed, only by thorough inspection and remediation can a quality end product be assured.

Typically, an inspector proceeds through the building, room by room, and shines a flashlight (in new construction, the building's electrical system is not yet hot) on the walls and any defects noted are outlined with chalk so that a remediation crew can follow behind the inspector and remedy the problem. This tried and true method of inspection works well but is not particularly efficient. Many inspectors carry the flashlight and a ladder that gives the inspector reach to all points of a wall and ceiling that have been dry walled in order to be able to mark areas above the inspector's normal reach. Whenever the inspector shines upon an area of the wall or ceiling that requires remediation, which area is beyond reach, the ladder is moved into place and ascended by the inspector so as to access the area that needs to be chalk marked. Once the defect area is marked, the inspector comes off the ladder and continues on with the inspection process, ladder once again in tow.

Requiring the inspector to tote the ladder is time-consuming and somewhat labor intensive, rendering the process relatively slow and inefficient. To address this concern, many inspectors place the chalk into a receiver located at the end of an extension pole. The receiver uses a locking compression collar (using an appropriately designed chuck) or similar device to lock the chalk into position on the end of the extension pole. When the inspector finds an area to be marked, which area is beyond the inspector's normal reach, the extension pole gives the inspector the additional reach needed to place the chalk mark at the desired area. While this method eliminates the need for hauling a ladder about the building during drywall inspection, the method is not without drawbacks. Due to the length of the extension pole, proper maneuvering of the pole is difficult with one hand while the inspector shines the flashlight onto the spot to be marked with the other hand. The inspector's pole holding hand and forearm quickly fatigue. To address the fatigue, the inspector uses both hands to maneuver the extension pole. While this works satisfactorily when there is sufficient ambient light available, in dark rooms, such as in internal rooms or when the inspections are being performed during non-daylight hours, the loss of the direct shine of the flashlight onto the spot to be marked, due to the need to stow the light in order to free both hands for the holding of the extension pole, proper placement of the mark may prove difficult. Some inspectors address this by placing the flashlight underneath an arm and maneuvering the flashlight along with the extension pole to the target spot. This process, clumsy at best, produces mixed results. Even when sufficient ambient light exists, the stowing and unstowing of the flashlight reduces the efficiency of the process.

Some inspectors address the above problem by having a head mounted light so that both hands are free to hold the extension pole. Once a target spot is identified, the inspector keeps eyes and the light from the head gear mounted light on the spot and marks the spot in the usual way. Although this alleviates the need for stowing and unstowing the light as well as the awkward underarm light holding, many find the wearing of the head gear for an extended period of time uncomfortable. Additionally, use of the head to scan the walls and ceiling of the building is more difficult physically and less efficient as the neck muscles lack the fine dexterity that are found in the wrist and hand muscles used for hand-held lights.

Accordingly, there exists a need in the art for a device that allows an inspector to be able to light up all dry walled surfaces of a room and be able to mark any deficiencies in the workmanship, which device overcomes the above stated problems found in the art. The device must not rely on the use of ladders (except in extreme cases) and must not require the user to don light-bearing head gear. Such a device must allow the inspector to have both hands constantly available to maneuver an extension pole that receives the marking chalk used for mark placements. Such a device must be readily usable in darkened rooms that lack sufficient ambient light to see without the aid of a flashlight. The device must allow for a smooth and fluid marking process without the need to stow and unstow the light each time a mark needs to be placed. Such a device must be of relatively simple design and construction and be easy to use and maintain.

SUMMARY OF THE INVENTION

The chalk holding device with light of the present invention addresses the aforementioned needs in the art by providing a device that allows an inspector to be able to shine a light onto all walls of a building in order to inspect the drywall work without the need to use head mounted lights. The chalk holding device with light allows the inspector to have both hands constantly available to maneuver an extension pole that receives the marking chalk used for mark placements wherein the extension pole eliminates the need to constantly tote a ladder about during the inspection process. The chalk holding device with light, by providing its own light source, is usable in any room without regard as to the availability of ambient light. The chalk holding device with light allows the inspector to perform the marking process in a smooth and fluid manner without the need to stow and unstow the light each time placement of a mark is desired. The chalk holding device with light is of relatively simple design and construction and is easy to use and maintain.

The chalk holding device with light is comprised of a pole member that has a first end and a second end and a medial section therebetween. A receiver has a compression ring located on the first end such that the receiver removably receives a piece of chalk therein and such that the compression ring, when rotated, firmly grips and holds the chalk within the receiver, and the compression ring, when counter-rotated, releases its grip on the chalk. A light source is attached to medial section of the pole member with the light source issuing a light beam in a direction that is the same as a longitudinal axis of the chalk. A threaded coupler may be attached to the second end of the pole member. The light source is a flashlight that may be attached to the medial section of the pole member via a first clamp such that the first clamp clamps onto the flashlight with the first clamp attached to the medial section of the pole member. A second clamp may be attached to the first clamp such that the second clamp clamps onto the medial section of the pole member. Alternately, the light source may comprise an LED ring that has a central opening and a plurality of LEDs located around its outer periphery, such that the medial section of the pole member passes through the central opening in order for the LED ring to encompass the medial section of the pole member. The central opening of the LED ring has a first diameter and the medial section of the pole has a second diameter that is similar to the first diameter.

BRIEF DESCRIPTION OF THE DRAWINGS

Similar reference numerals refer to similar parts throughout the several views of the drawings.

DESCRIPTION OF THE PREFERRED EMBODIMENT

Figure 1:
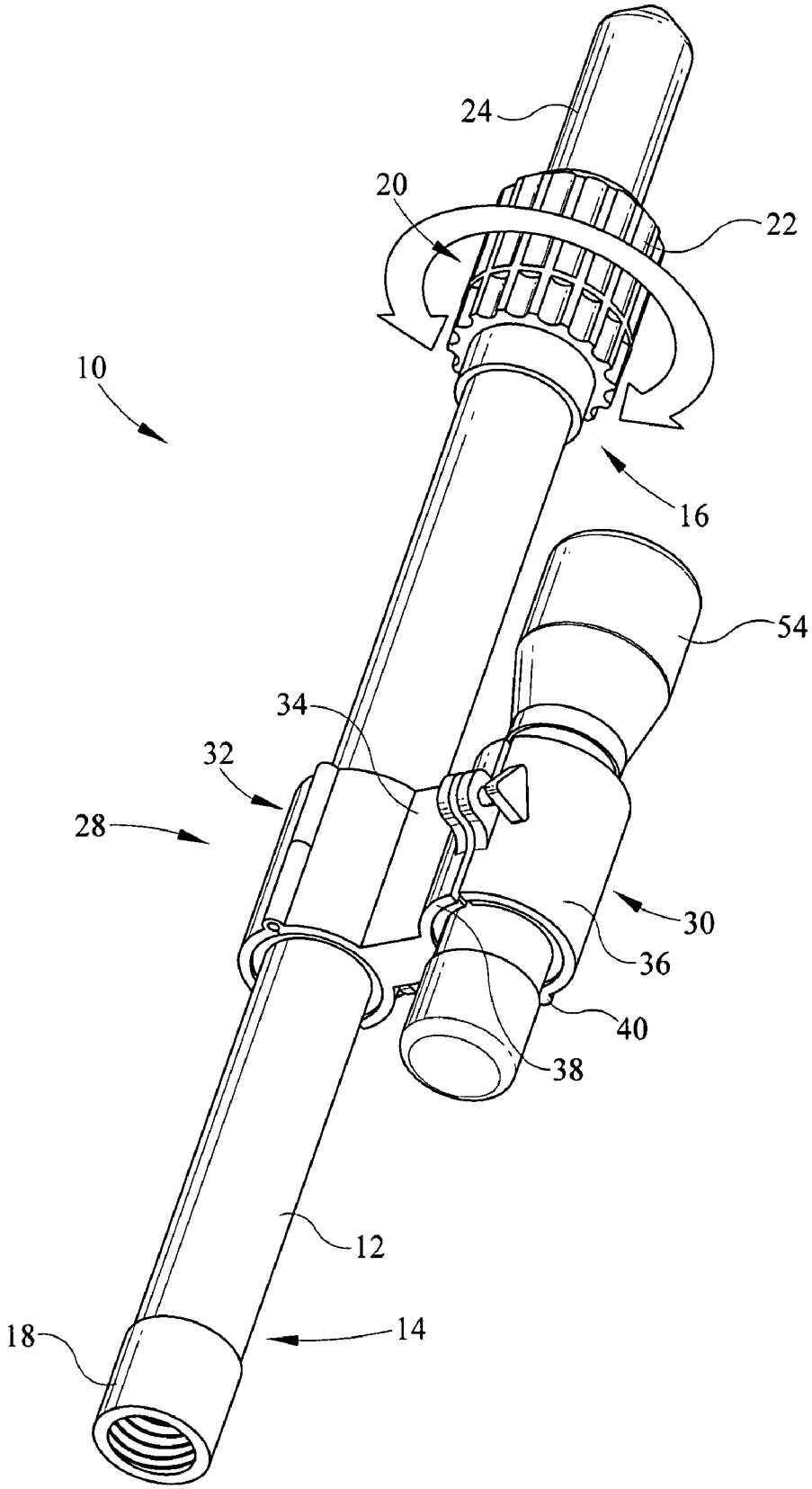
FIG. 1 is a perspective view of the chalk holding device with light of the present invention.
Figure 2:
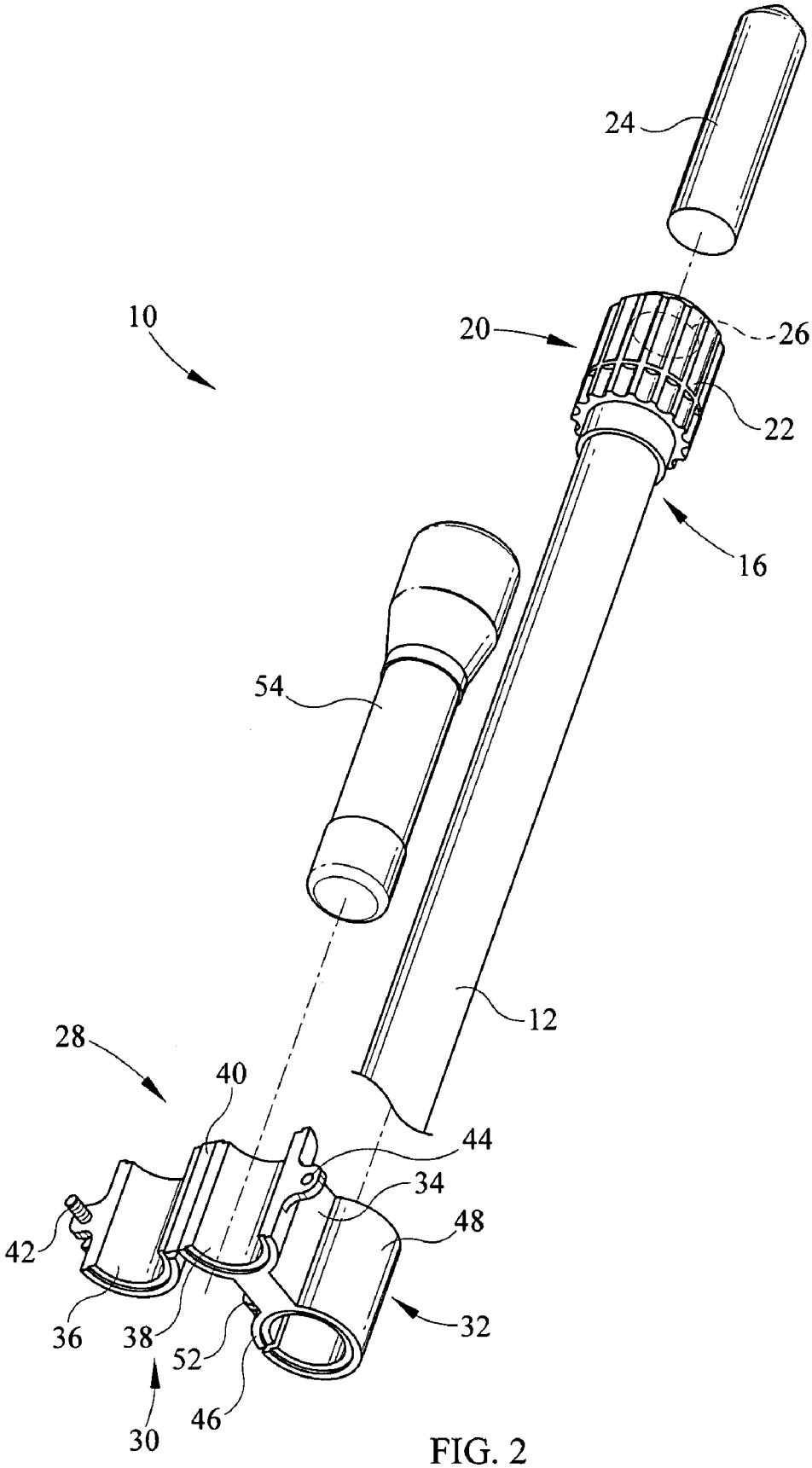
FIG. 2 is an exploded view of the chalk holding device with light.
Figure 3:
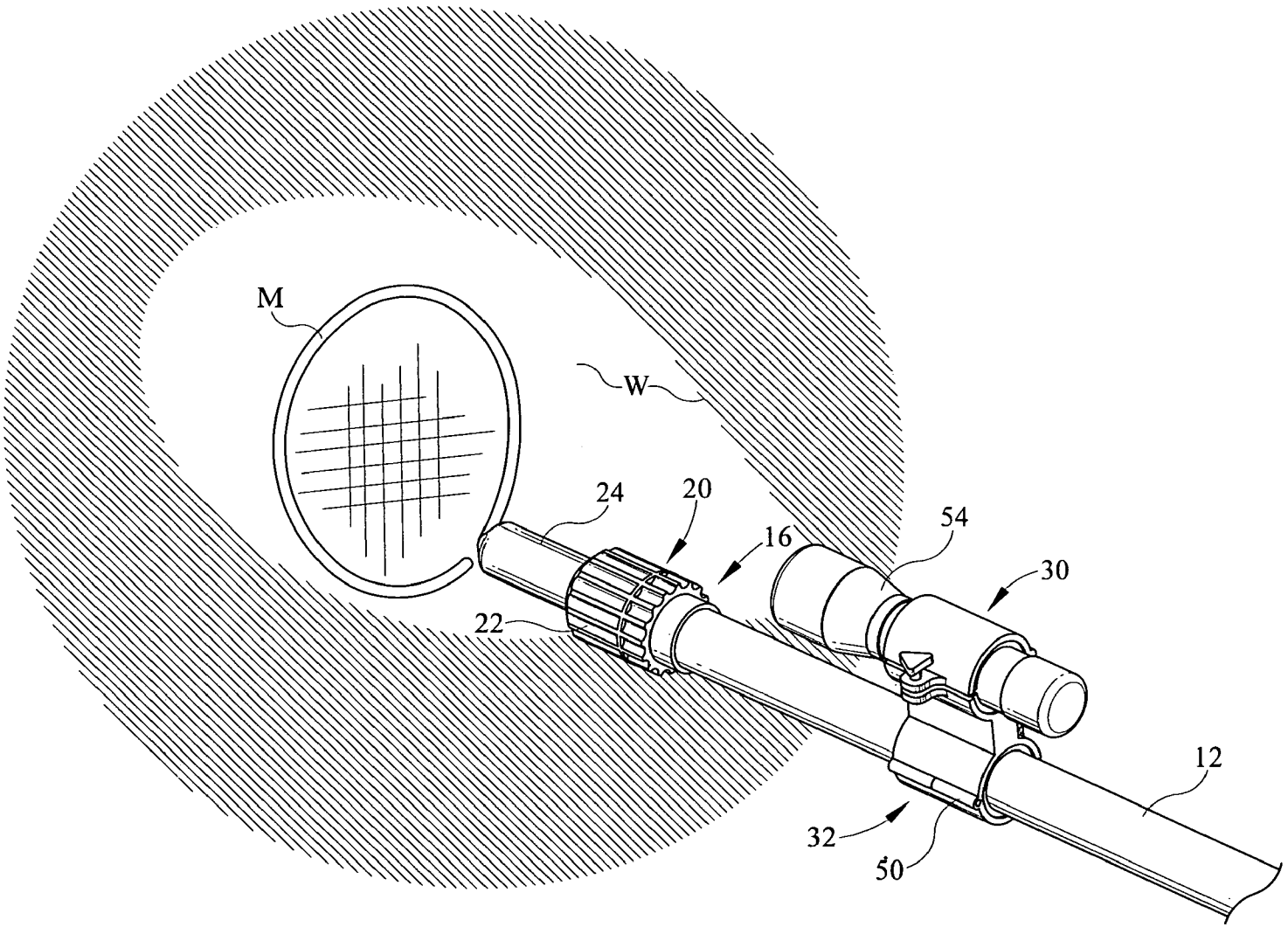
FIG. 3 is a perspective view of the chalk holding device with light being used to place a mark onto a wall surface.

Referring now to the drawings, it is seen that the chalk holding device with light of the present invention, generally denoted by reference numeral 10, is comprised of a pole member 12 having a proximal end 14 and a distal end 16. As seen, the proximal end 14 may have a threaded coupler 18 thereat, as best seen in FIG. 1, so that the device 10 can be threadably coupled to any appropriate extension pole (not illustrated) known in the art. Alternately, the pole member 12 may serve the additional role as an extension pole. Located at the distal end 16 of the pole member 12 is a chalk receiver 20 that has a rotatable compression ring 22 such that when a piece of chalk 24 is received within an open top 26 of the distal end 16, the ring 22 is rotated in order to lock the chalk 24 within the receiver 20. Counterrotation of the ring 2 unlocks the receiver 20 allowing the chalk 24 to be removed therefrom.

Located along a length of the pole member 12, between the proximal end 14 and the distal end 16, is a clamping system 28 that has a first clamp 30 joined to a second clamp 32 by an appropriate bridge 34. The clamps 30 and 32 may be of any appropriate design in the art such that the first clamp 30 may comprise a first jaw 36 and a second jaw 38 joined to the first jaw 36 by a first hinge 40. A first screw 42 is located on the first jaw 36 and is threadably received within a first receiver 44 located on the second jaw 38 in order to lock the first jaw 36 and the second jaw 38 together. Similarly, the second clamp 32 may comprise a third jaw 46 and a fourth jaw 48 joined to the third jaw 46 by a second hinge 50. A second screw 52 is located on the third jaw 46 and is threadably received within a second receiver (not separately illustrated) located on the fourth jaw 48 in order to lock the third jaw 46 and the fourth jaw 48 together. The first clamp 30 receivers a flashlight 54 therein, while the second clamp 32 encompasses and clamps onto the pole member 12.

In order to use the chalk holding device with light 10 of the present invention, a piece of chalk 24 is positioned through the open top 26 of the distal end 16 of the pole member 12 and the ring 22 of the chalk receiver 20 is rotated in order to lock the chalk 24 therein. The clamping system 28 is attached to the pole member 12 by positioning the first clamp 30 about the flashlight 54 and locking the first jaw 36 to the second jaw 38 thereabout using the first screw 42 and first receiver 44 in order for the first clamp 30 to clamp onto the flashlight 54 and to hold the flashlight 54 firmly thereat. The second clamp 32 is clamped onto the pole member 12 such that the jaws 46 and 48 are locked together thereabout using the second screw 52 and second receiver in order to clamp the pole member 12 firmly in place. The light beam issued by the flashlight 54 is in the same direction as the direction to which the chalk 24 is pointing. The pole member 12 is attached to an appropriate extension pole as desired. During the inspection, the flashlight 54 is activated and is used to shine onto the walls W of the building being inspected, the flashlight 54 being manipulated by the pole member 12 or extension pole if used. When a deficiency is spotted, the chalk 24 is used to place a mark onto the wall W at the desired location. As the flashlight 54 is attached directly to the pole 12 holding the chalk 24, the user is capable of using both hands to grasp the pole 12 (or extension) and the flashlight 54 simultaneously. In this way, when a spot to be marked is identified, the flashlight 54 remains on target the entire time during marking, eliminating the need to stow and unstow the flashlight 54. The use of quick release clamps 30 and 32 allows for quick release and replacement of the flashlight 54 from the remainder of the device 10 when a different strength light is needed or when the flashlight 54 simply wears out.

Figure 4:
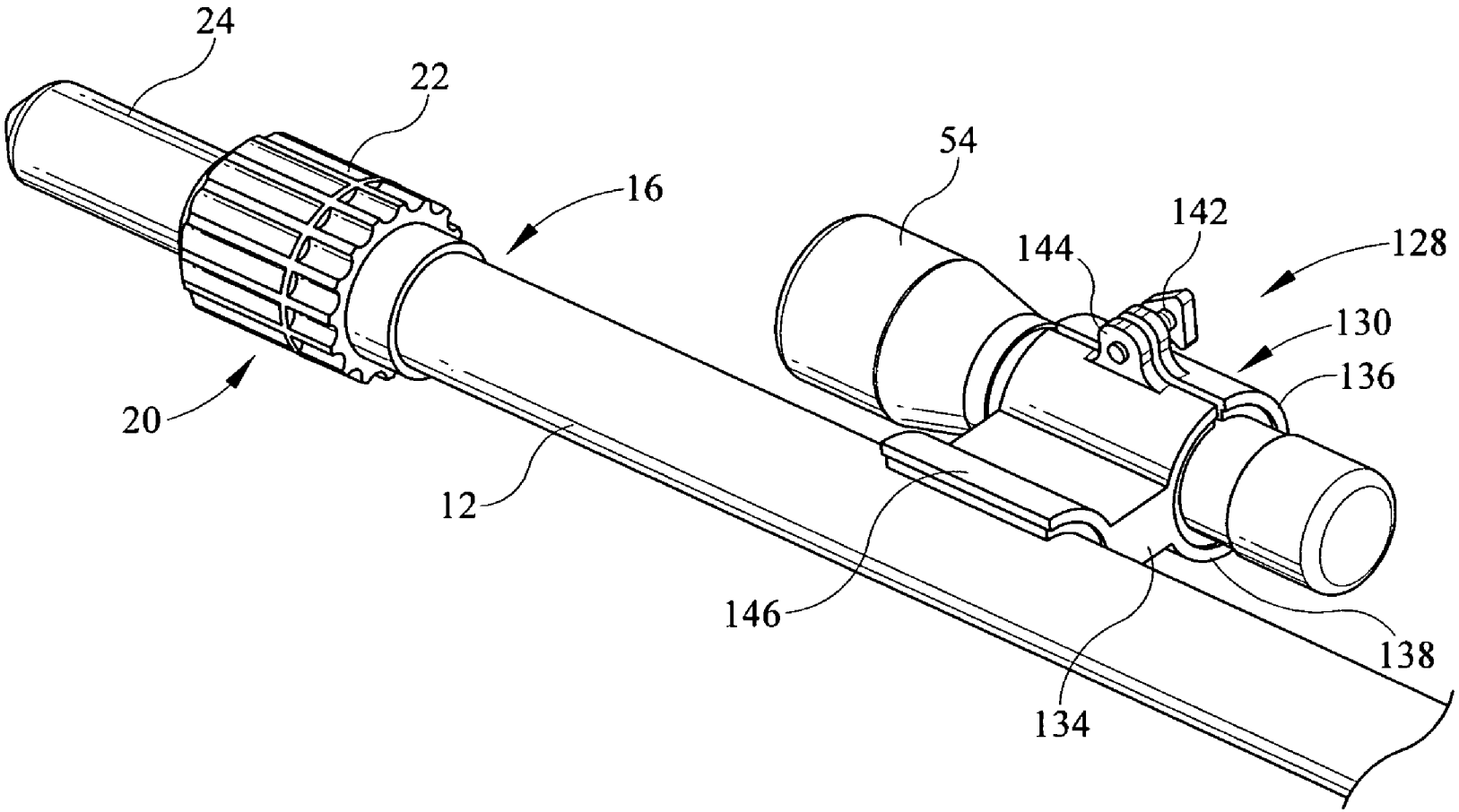
FIG. 4 is a perspective view of the upper section of an alternate embodiment of the chalk holding device with light of the present invention.

As seen, in FIG. 4, the clamping system 128 may have but a single clamp 130 configuration, with a first jaw 136 and a second jaw 138 joined by a hinge (not illustrated) with a screw 142 being received within a receiver 144 to lock the first jaw 136 with the second jaw 138, wherein the clamping system 128 is attached directly to the pole member 12 via the bridge 134 by adhering or welding the bridge 134 directly to the pole member 12. As seen, the bridge 134 may have a partial arcuate-shaped extension 146 located thereon for better adherence of the bridge 134 to the pole member 12

Figure 5:
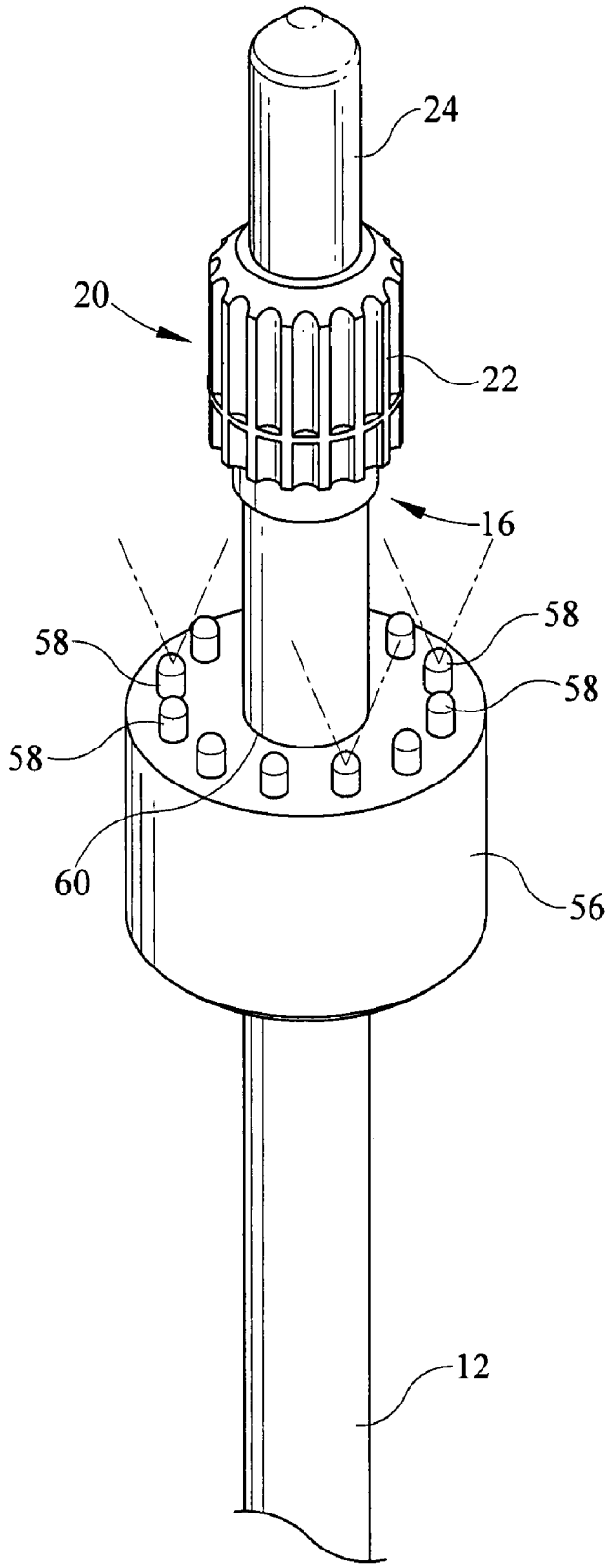
FIG. 5 is a perspective view of the upper section of a second alternate embodiment of the chalk holding device with light of the present invention.

As seen in FIG. 5, the clamping system may be eliminated entirely by using an LED ring 56 having a plurality of LEDs 58 located about its outer periphery. The LED ring 56 has a central opening 60. The pole member 12 passes through the opening 60 (by first removing either the threaded coupler 18 or the chalk receiver 20) such that the LED ring 56 is fixed in place about the pole member 12. Such fixing may be in any appropriate manner such as by adhering or welding the LED ring 56 in place, use of appropriate holding devices (clamps, retention rings, etc.,—none illustrated), etc. The LEDs 58 provide the working light for the device 10. Advantageously, the opening 60 of the LED ring 56 is sized to be substantially similar to the outer diameter of the pole member 12 in order to ensure a snug encompassing fit of the LED ring 56 to the pole member 12.

While the invention has been particularly shown and described with reference to embodiments thereof, it will be appreciated by those skilled in the art that various changes in form and detail may be made without departing from the spirit and scope of the invention.

I claim:

1. A holding device comprising:

a pole member having a first end and a second end and a medial section therebetween;

a piece of chalk;

a receiver having a compression ring and an extension, the extension located on the first end, the receiver removably receiving the piece of chalk therein such that the compression ring, when rotated, firmly grips and holds the chalk within the receiver, and the compression ring, when counterrotated, releases its grip on the chalk; and a light source attached to medial section of the pole member, the light source issuing a light beam in a direction that is the same as a longitudinal axis of the chalk; and wherein the light source comprises an LED ring having a central opening and a plurality of LEDs located around an outer periphery, such that the medial section of the pole member passes through the central opening in order for the LED ring to encompass the medial section of the pole member.

2. The holder as in claim 1 further comprising a threaded coupler attached to the second end of the pole member.

3. The holder as in claim 1 wherein the central opening has a first diameter and the medial section of the pole has a second diameter that is similar to the first diameter.

* * * * *